US006979473B2

(12) United States Patent
O'Connor et al.

(10) Patent No.: US 6,979,473 B2
(45) Date of Patent: Dec. 27, 2005

(54) METHOD FOR FINE BORE ORIFICE SPRAY COATING OF MEDICAL DEVICES AND PRE-FILMING ATOMIZATION

(75) Inventors: Tim O'Connor, Claregalway Co. Galway (IE); Gabriel Sobrino, Galway (ES)

(73) Assignee: Boston Scientific SciMed, Inc., Maple Grove, MN (US)

( * ) Notice: Subject to any disclaimer, the term of this patent is extended or adjusted under 35 U.S.C. 154(b) by 0 days.

(21) Appl. No.: 10/799,589

(22) Filed: Mar. 15, 2004

(65) Prior Publication Data

US 2005/0202156 A1 Sep. 15, 2005

(51) Int. Cl.[7] ..... B05D 3/00
(52) U.S. Cl. ..... 427/2.24; 427/2.25; 427/421
(58) Field of Search ..... 427/2.24, 2.25, 427/421, 427

(56) References Cited

U.S. PATENT DOCUMENTS 3,735,778 A 5/1973 Garnier
4,575,609 A 3/1986 Fassel
6,322,847 B1 11/2001 Zhong et al.
6,811,805 B2 * 11/2004 Gilliard et al. ..... 427/2.1

FOREIGN PATENT DOCUMENTS

DE 719 129 C 3/1942
DE 202 00 223 U1 3/2002

* cited by examiner

*Primary Examiner*—Bret Chen
(74) *Attorney, Agent, or Firm*—Kenyon & Kenyon

(57) ABSTRACT

A method for spray deposition of small targets, such as medical devices like stents. The method includes the steps of positioning a spray nozzle body, which has a fine bore diameter to pressurize the coating material within the nozzle body, near a medical device, and dampening vibration of the nozzle body during operation by maintaining a steady back pressure in the coating material line sufficient to eliminate or minimize vibration modes from external and internal sources; and stabilizing the spray coating plume. In another embodiment, a coating method is disclosed in which a finer atomized spray droplet size is achieved by pre-filming the coating material onto a flat face before entraining the coating material within the atomizing fluid, which improves manufacturing repeatability, reduces coating variances, and increases therapeutic dosage predictability. In certain embodiments of the invention, the coating materials include therapeutic agents and biologically active materials.

9 Claims, 4 Drawing Sheets

METHOD FOR FINE BORE ORIFICE SPRAY COATING OF MEDICAL DEVICES AND PRE-FILMING ATOMIZATION

FIELD OF THE INVENTION

The field of the present invention involves the application of coatings to target devices, such as medical devices. More specifically, the present invention is directed to the field of spray coating a fluid, such as a therapeutic or protective coating fluid, onto a target device.

BACKGROUND

The positioning and deployment of medical devices within a patient is a common, often-repeated procedure of contemporary medicine. Such medical devices or implants are used for innumerable medical purposes, including the reinforcement of recently re-enlarged lumens, or the replacement of ruptured vessels.

Coatings are often applied to the surfaces of these medical devices to increase their effectiveness. These coatings may provide a number of benefits including reducing the trauma suffered during the insertion procedure, facilitating the acceptance of the medical device into the target site, and improving the post-procedure effectiveness of the device.

Coating medical devices also provides for the localized delivery of therapeutic agents to target locations within the body, such as to treat localized disease (e.g., heart disease) or occluded body lumens. Such localized delivery of therapeutic agents has been achieved using medical implants which both support a lumen within a patient's body and place appropriate coatings containing absorbable therapeutic agents at the implant location. This localized drug delivery avoids the problems of systemic drug administration, such as producing unwanted effects on parts of the body which are not to be treated, or not being able to deliver a high enough concentration of therapeutic agent to the afflicted part of the body. Localized drug delivery is achieved, for example, by coating expandable stents, coronary stents, stent grafts, vascular grafts, catheters, balloon catheters, balloon delivery systems, aneurism coils, guide wires, filters (e.g., vena cava filters), intraluminal paving systems, implants and other devices which directly contact tissue, e.g., the inner vessel wall, with the therapeutic agent to be locally delivered.

The delivery of expandable stents is a specific example of a medical procedure that may involve the deployment of coated implants. Expandable stents are tube-like medical devices that often have a mesh-like patterned structure designed to support the inner walls of a lumen. These stents are typically positioned within a lumen and, then, expanded to provide internal support for it. Because of the direct contact of the stent with the inner walls of the lumen, stents have been coated with various compounds and therapeutics to enhance their effectiveness. The coating on these medical devices may provide for controlled release, which includes long-term or sustained release, of a biologically active material.

Aside from facilitating localized drug delivery, medical devices are coated with materials to provide beneficial surface properties. For example, medical devices are often coated with radiopaque materials to allow for fluoroscopic visualization during placement in the body. It is also useful to coat certain devices to achieve enhanced biocompatibility and to improve surface properties such as lubriciousness.

Conventionally, coatings have been applied to medical devices by processes such as dipping or spraying. For example, spray coating generally involves spraying the coating substance onto the device. Dipping, or spin-dipping, generally involves dipping a (static or spinning) device into a coating solution to achieve the desired coating. Another example, electrostatic fluid deposition, typically involves applying an electrical potential difference between a coating fluid and a target to cause the coating fluid to be discharged from the delivery point and drawn toward the target. Common to these processes is the need to apply the coating in a manner to ensure that a uniform, robust coating of the desired thickness is formed on the medical device or stent.

These conventional coating processes are often, however, indiscriminate and/or difficult to control. For example, dipping can result in non-uniform application of the coating to the device because gravity and longer exposure time may cause more coating to be applied at one end or region of the device, thus the coating may be thicker at one end. With respect to conventional spray coating and electrostatic spray deposition, empirical experience has shown that the spray plume stability of a spray nozzle used in both spraying and electrostatic spray coating is affected by vibration. The vibration may come from several sources, including, for example, fans and motors proximate to the spray plume and potential pressure variances within the coating fluid supply line which may cause flow interruptions or shock waves. Instability in the spray plume caused by vibration can cause variability in coating thickness and weight and reduce manufacturing reproducibility. Additionally, the venturi effect of the atomizing fluid may pull more coating fluid from the spray nozzle, which further limits controllability over the spray plume.

In addition, conventional spray nozzles typically provide a wide range of spray droplet sizes, which increases coating variance. Further, conventional spray nozzles typically have a dome-shaped nozzle geometry which limits controllability of spray droplet size as the coating material is pulled directly from the orifice due to the venturi effect of the atomizing fluid.

Thus, coating thickness can vary significantly on an individual target-to-target basis. Such variability could be detrimental to obtaining consistent coating distribution and thickness on the target, making it difficult to predict the dosage of therapeutic that will be delivered when the medical device or stent is implanted.

There is, therefore, a need for a cost-effective method and apparatus for coating the surface of a target or medical device that can provide one or more benefits such as increasing coating uniformity, improving manufacturing repeatability, minimizing waste in coating medical devices with expensive active agents, and/or permitting precise control of coating deposition rates, leading to highly efficient production systems.

The assignee of the current patent application is also the assignee of another patent application directed to resolving some of the problems noted above. The disclosure of U.S. patent application Ser. No. 10/774,483, filed Feb. 10, 2004, and entitled, "Apparatus and Method for Electrostatic Spray Coating of Medical Devices," is hereby incorporated herein by reference.

SUMMARY OF THE INVENTION

The present invention is directed to an improved and/or simplified spray coating apparatus and method.

In certain embodiments of the invention, a method is provided for applying a coating material with a spray coating fluid delivery apparatus having a constricting outlet nozzle orifice with a fine bore diameter. This fine bore nozzle orifice increases back pressure of the coating material within the spray apparatus and chokes the coating material supply line, thereby dampening the vibration of the apparatus, resulting in a more stable spray plume of coating, a smaller spray droplet size for enhanced atomization, and a more uniform coating application.

In another embodiment of the present invention, a method for stabilizing a spray plume of a spray apparatus is provided in which the coating material flows from a fine bore nozzle orifice onto an adjacent surface thereby creating a thin film layer of coating material at an angle to the directional flow of the atomizing fluid. Edge portions of the thin film are then entrained within the high velocity atomizing fluid as the atomizing fluid flows by the edge of the flat surface. This pre-filming step permits a more stable plume having a finer spray droplet with less size variance.

In another embodiment of the present invention, a method for atomizing a coating material into fine spray droplets is provided that includes a pre-filming step in which a film layer of coating material is thinly spread upon a surface. A portion of that film layer is then entrained within the high velocity atomizing fluid to improve atomization.

In yet another embodiment of the present invention, an apparatus for spray coating a medical device comprising a constricted fine bore coating nozzle orifice and a surface for pre-filming coating material for atomization is provided.

The present invention provides a method and apparatus to provide one or more benefits such as to damp out vibration, stabilize the spray plume, reduce coating variability, and/or reduce coating material spray droplet size, leading to improved coating material transfer and uniformity in a more cost-efficient manner.

DETAILED DESCRIPTION

Figure 1:
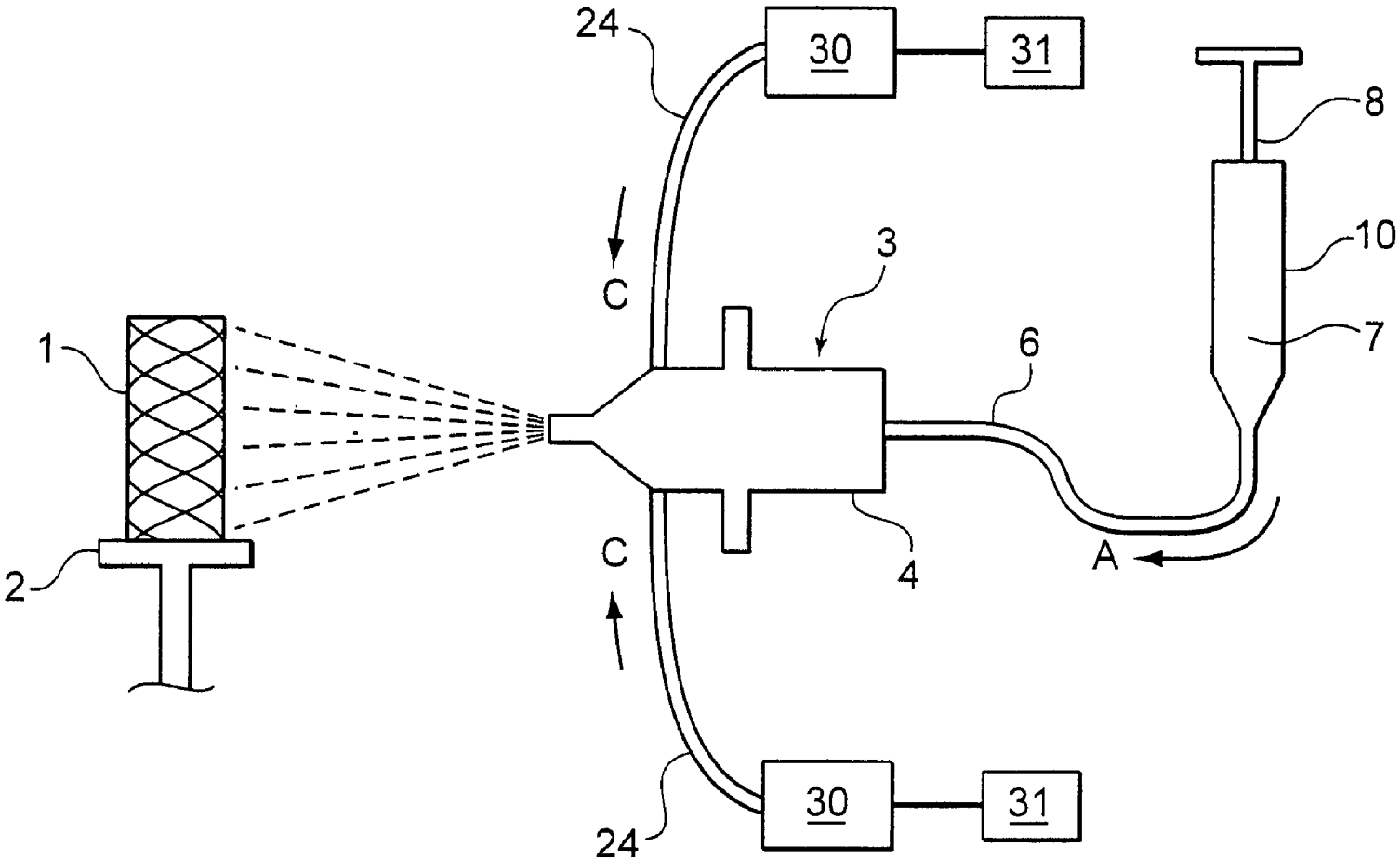
FIG. 1 is a schematic view of a first embodiment of a spray coating fluid delivery apparatus in accordance with the present invention.

A first embodiment of the present invention is illustrated in FIG. 1. In this embodiment, a target 1 to be coated with a coating fluid is held by target holder 2. Target 1 in this instance is a stent that is to be coated with a therapeutic material. Stent holder 2 may hold stent 1 by any number of means, such as by the stent holders described in U.S. patent application Ser. No. 10/198,094, which shares a common assignee to the pending application at bar, and the disclosure of which is hereby expressly incorporated by reference herein.

Proximate to stent 1 and holder 2 is a spray coating fluid delivery device 3, schematically illustrated in FIG. 1. Spray delivery device 3 includes a nozzle body 4, coating fluid reservoir 7, a coating fluid supply line 6 in fluid communication with a coating fluid reservoir 7 and nozzle body 4, atomizing fluid reservoir 30, and an atomizing fluid supply line 24 in fluid communication with atomizing fluid reservoir 30 and nozzle body 4. The coating material is located within reservoir 7, and the atomizing fluid is located within reservoir 30. Although FIG. 1 depicts spray delivery device 3 with two atomizing fluid supply lines 24, one of ordinary skill in the art will appreciate that delivery device 3 may have a single or multiple atomizing fluid supply lines and/or coating fluid supply lines.

A piston type mechanical apparatus having a plunger 8 and plunger barrel 10 pressurizes the coating material within the fluid supply line. As illustrated in FIG. 1, the plunger barrel 10 may also include reservoir 7. Alternatively, the reservoir may be separate from the piston type mechanical apparatus. One of ordinary skill in the art would appreciate that a variety of devices may be used to pressurize the coating material fluid. For example, a pump, actuator and motor, syringe, or bellows may be utilized. An atomizing pump, shown schematically as 31, may be used to pump atomizing fluid from reservoir 30 to nozzle body 4.

Figure 2:
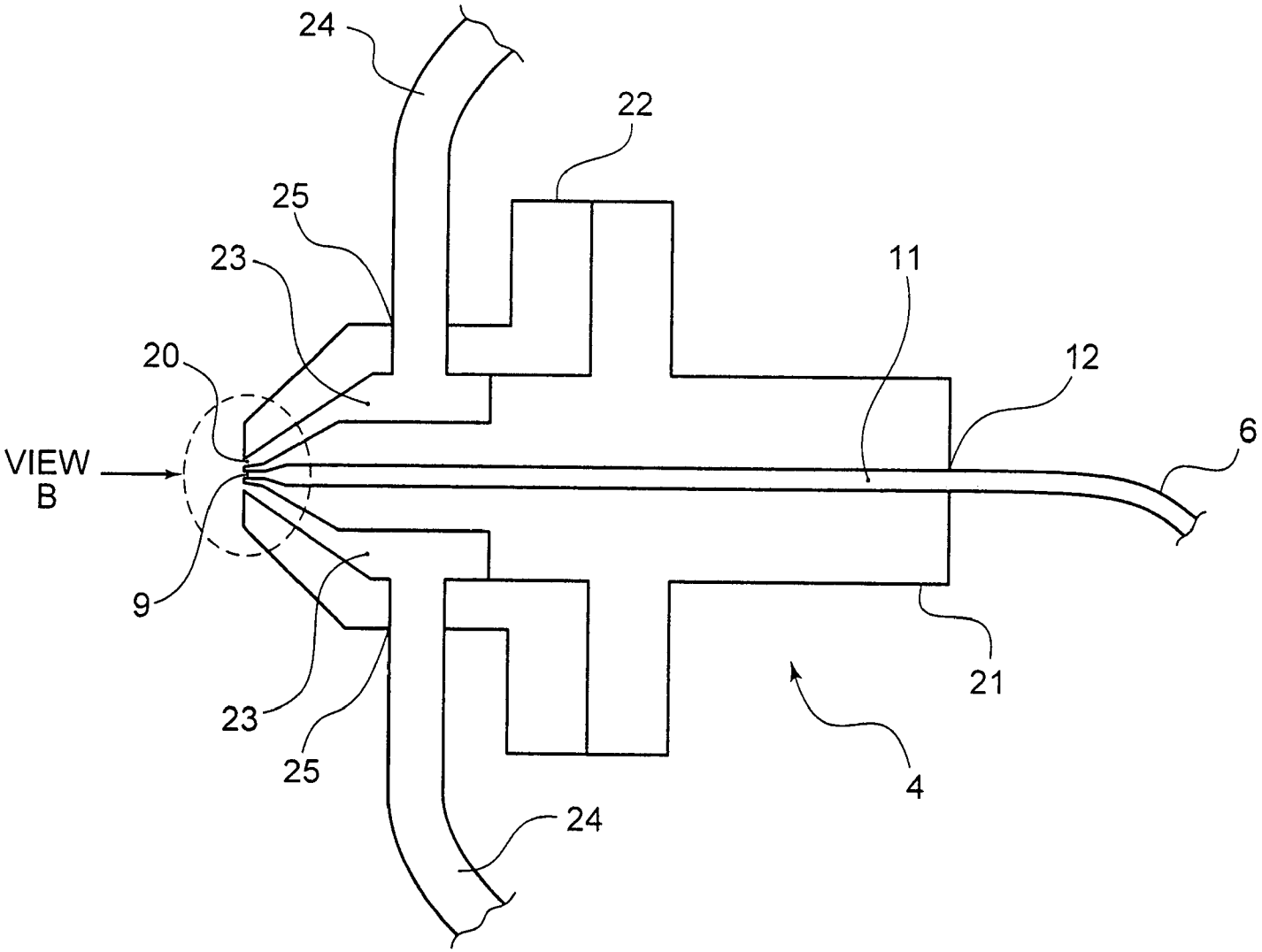
FIG. 2 is an enlarged cross-sectional view of a nozzle body of the spray coating fluid delivery apparatus of FIG. 1.
Figure 3:
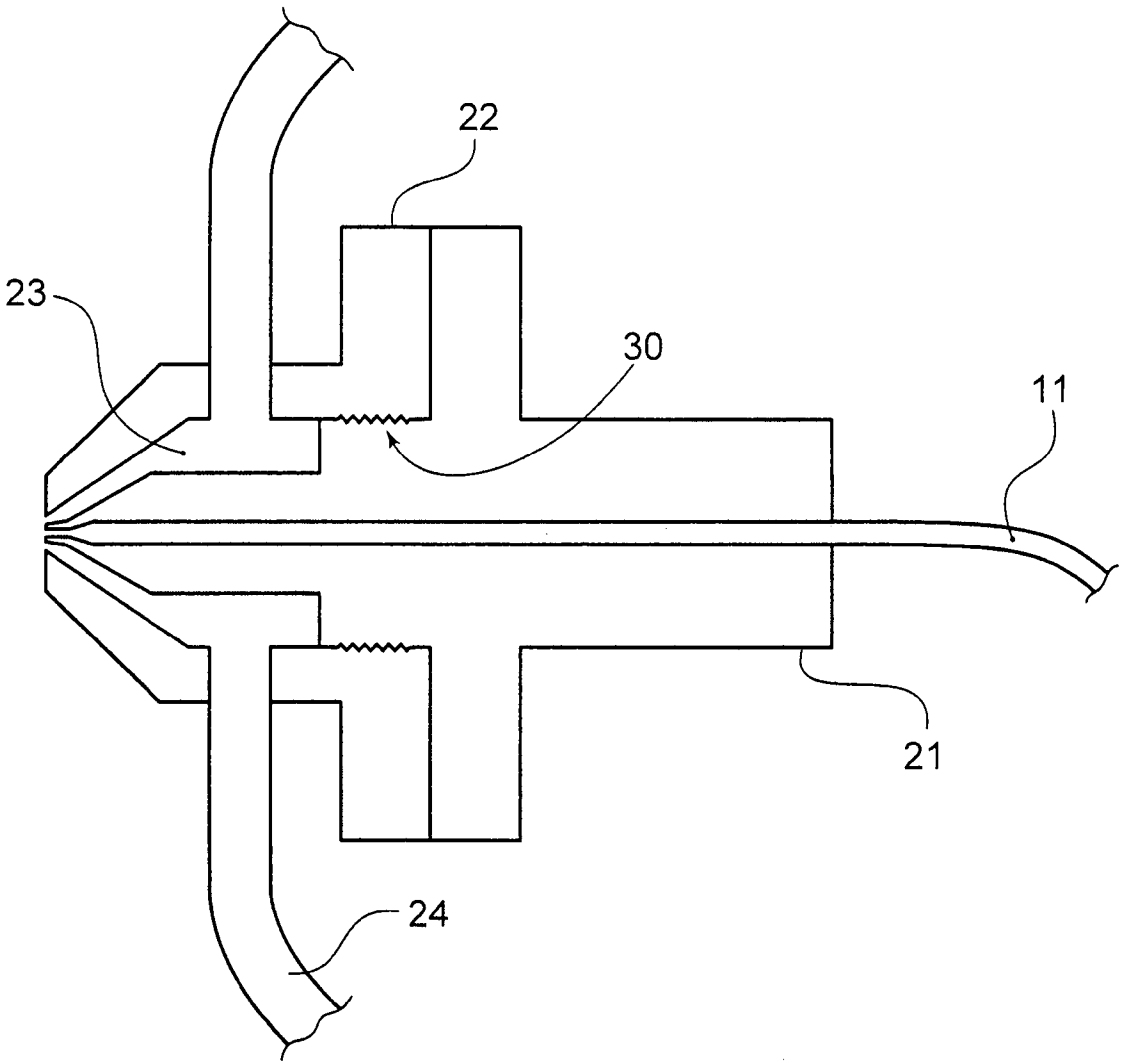
FIG. 3 is an enlarged cross-sectional view of another embodiment of a nozzle body of the spray coating fluid delivery apparatus in accordance with the present invention.

One of ordinary skill in the art will appreciate that a variety of designs exist for spray nozzle body 4. For example, nozzle body 4 of spray delivery device 3 may comprise of multiple parts. As shown in FIG. 2, the nozzle body 4 may include coating nozzle body 21 and atomizing ring 22. The assembly of coating nozzle body 21 and atomizing ring 22 creates an atomizing fluid passageway 23, positioned concentric to coating fluid passageway 11. Atomizing ring 22 and coating nozzle body 21 are assembled by press-fitting the ring 22 onto the body 21 to minimize variances in concentricity. One of ordinary skill in the art will appreciate that atomizing ring 22 and coating nozzle body 21 may be snap-fitted or threaded by threads 30 (as shown in the alternate embodiment of FIG. 3). Further, one of ordinary skill in the art will appreciate that a seal (not shown) may be used to seal the atomizing ring 22 and body 21. Alternatively, nozzle body 4 may be a unitary body design (not shown) with coating fluid passageway 11 and atomizing fluid passageway 23 cast or machined therein. Nozzle body 4 may be made from a solvent-resistant material, preferably an easily cleaned material such as stainless steel. A commercially available stainless steel nozzle may be suitably adapted for use in the present invention with relatively minor modifications. One of ordinary skill in the art will appreciate that the nozzle body may be constructed from a variety of materials.

Figure 4:
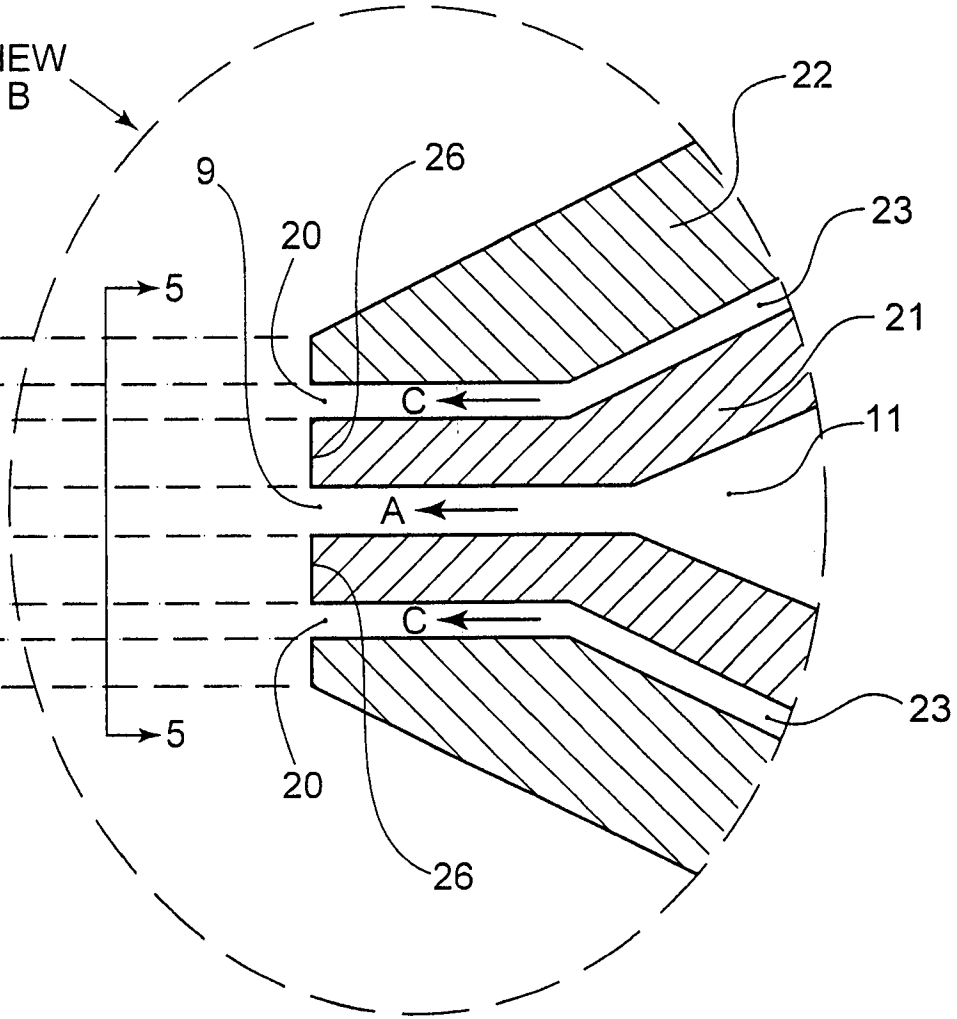
FIG. 4 is an enlarged cross-sectional view of a portion of a nozzle body of the spray coating fluid delivery apparatus taken at View B of FIG. 2 in accordance with the present invention.

Referring to FIG. 2, atomizing fluid passageway 23 fluidly communicates with atomizing fluid supply line 24, and coating fluid passageway 11 fluidly communicates with coating fluid supply line 6. Further, as shown in FIG. 4, atomizing fluid passageway 23 fluidly communicates with atomizing nozzle orifice 20, and coating fluid passageway 11 fluidly communicates with coating nozzle orifice 9. Adjacent to and circumferentially surrounding coating nozzle orifice 9 of coating nozzle body 21 lies surface 26, as illustrated in FIG. 4. In a preferred embodiment, surface 26 of coating nozzle body 21 is a flat surface that lies in the same plane as coating nozzle orifice 9, and perpendicular to the flow direction of the atomizing fluid (shown in FIG. 4 as directional arrow C) in atomizing fluid passageway 23. Alternate embodiments may include a flat surface 26 slightly angled from coating nozzle orifice 9, and approximately perpendicular to the flow direction of the atomizing fluid.

In operation, the operator positions the coating nozzle orifice 9 (shown in FIGS. 2 and 4) of nozzle body 4 adjacent the target (here, stent 1 of FIG. 1). As illustrated in FIG. 2, coating fluid supply line 6 cooperates with an coating fluid passageway 11 through inlet 12 of coating nozzle body 21 to supply coating fluid from the fluid reservoir 7 (shown in FIG. 1) to coating nozzle orifice 9 facing target 1. Referring to FIG. 1, when the plunger 8 is moved longitudinally within the plunger barrel 10, the coating fluid supply line 6 is pressurized, and coating fluid flows generally in the direction of direction arrow A towards coating nozzle orifice 9. One of ordinary skill in the art will appreciate that a pump or compressor may also be used to pressurize the coating fluid.

As the coating fluid passes through coating fluid passageway 11 towards coating nozzle orifice 9, the fluid pressure of the coating material builds as it approaches constricted coating nozzle orifice 9, as illustrated in FIGS. 2 and 4. The diameter of the coating nozzle orifice 9 is reduced to less than 0.35 mm to increase back pressure upon the column of coating fluid within the coating fluid supply line 11, lower the flow rate of the coating fluid material, and produce a larger pressure drop across the orifice. This increased back pressure dampens nozzle body vibration, which promotes a more stable spray plume of coating and provides a more uniform coating application. Further, the finer bore orifice reduces the venturi effect upon the orifice 9, creating a more stable spray plume and improving coating controllability and repeatability. One of ordinary skill in the art will appreciate that the diameter of the coating nozzle orifice may be changed to create more or less back pressure within the coating material as needed. Nozzle diameters as low as 0.15 mm have been utilized to increase the pressure and promote smaller coating material droplet size giving a finer spray. It will be appreciated that for particular applications nozzle diameters between 0.15 mm and 0.35 mm as well as below 0.15 mm may be used.

The increased pressure chokes the coating fluid supply line 11 to maintain steady pressure throughout the supply line 11 during operation, thereby eliminating or minimizing shock wave propagation and pressure fluctuations within the supply line that can effect coating operation. Further, constant internal pressure within the coating nozzle body 21 stabilizes the spray apparatus against external vibration modes induced by external fans and motors. This dampening effect will reduce variability in coating weight and thickness on the target or stent, thereby enhancing process repeatability and therapeutic dosage predictability. Further, this method would permit precise control of coating deposition rates and minimize waste in coating with expensive active agents.

Once the coating material is ejected from the coating nozzle orifice 9, the flow rate increases while the pressure drops. The coating material is then atomized into fine spray droplets by entraining portions of the coating material within the atomizing fluid. Referring to FIGS. 1, 2 and 4, atomizing fluid is supplied through atomizing fluid supply line 24, which fluidly cooperates with atomizing reservoir 30, atomizing fluid passageway 23, and atomizing nozzle orifice 20. As shown in FIG. 1, pump 31 pumps atomizing fluid from reservoir 30 into supply line 24 in the direction of direction arrow C. Atomizing fluid then flows from supply line 24 into atomizing fluid passageway 23 at inlet 25 of atomizing ring 22, as shown in FIG. 2. Atomizing fluid finally is ejected from passageway 23 through atomizing nozzle orifice 20 in the direction of direction arrow C, as illustrated in FIG. 4, at a high velocity.

Atomization occurs when the coating fluid is ejected from the coating nozzle orifice 9 into a low-pressure region created by the high velocity atomization fluid annulus surrounding the dispensed coating fluid and entrained within the atomizing gas annulus flow. The atomized coating material is then sprayed onto stent 1. One of ordinary skill in the art will appreciate that a variety of fluids may be pressurized and used to enhance atomization and discharge of the coating material from the coating nozzle orifice. For example, nitrogen gas or air may be pressurized and used to atomize the coating material.

Figure 5:
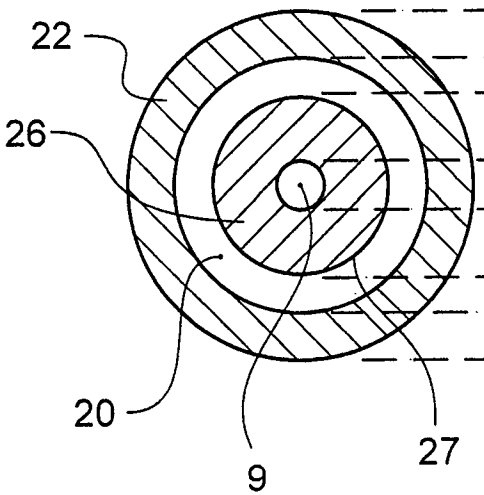
FIG. 5 is an enlarged end view of a portion of a nozzle body of the spray coating fluid delivery apparatus taken along line 5—5 of FIG. 4 in accordance with the present invention.

In an alternate embodiment, atomization of the coating fluid material can be enhanced by first spreading the coating material into a thin film layer in a pre-filming step. Referring to FIG. 4, as the coating fluid emerges from the coating nozzle orifice 9, the coating material flows from orifice 9 onto the surrounding flat surface 26. The flat face 26 creates a recirculation area of low pressure which draws the coating material from orifice 9 onto the flat face 26 in a thin film. This pre-filming step allows a thin layer of coating material to form on flat surface 26. The layer of coating material is particularly thin at edge 27 of flat surface 26, as illustrated in FIG. 5. The atomizing fluid flow forms a fluid annulus surrounding the edge 27 of flat surface 26 when the flat surface 26 is angled to the flow direction of atomizing fluid. In the preferred embodiment, the flat surface 26 is positioned perpendicular to the flow direction of the atomization fluid. One of ordinary skill in the art will appreciate that flat surface 26 may be slightly angled from orifice 9 and approximately perpendicular to atomizing fluid flow direction (shown as direction arrow C in FIG. 4). Flat surface 26 also has a smooth finish to promote thinning of the coating material as it flows onto the flat surface.

This concentric coaxial arrangement creates smaller, finer spray droplets with reduced size variance. Further, concentricity of the assembled nozzle orifices will promote an even, consistent, and concentric spray plume. Pre-filming improves manufacturing repeatability and reduces coating variances in thickness, thereby increasing threrapeutic dosage predictability.

With regard to the coatings discussed above, the term "therapeutic agent" as used herein includes one or more "therapeutic agents" or "drugs." The terms "therapeutic agents" and "drugs" are used interchangeably herein and include pharmaceutically active compounds, nucleic acids with and without carrier vectors such as lipids, compacting agents (such as histones), virus (such as adenovirus, andenoassociated virus, retrovirus, lentivirus and α-virus), polymers, hyaluronic acid, proteins, cells and the like, with or without targeting sequences. Specific examples of therapeutic agents used in conjunction with the present invention include, for example, pharmaceutically active compounds, proteins, cells, oligonucleotides, ribozymes, anti-sense oligonucleotides, DNA compacting agents, gene/vector systems (i.e., any vehicle that allows for the uptake and expression of nucleic acids), nucleic acids (including, for example, recombinant nucleic acids; naked DNA, cDNA, RNA; genomic DNA, cDNA or RNA in a non-infectious vector or in a viral vector and which further may have attached peptide targeting sequences; antisense nucleic acid (RNA or DNA); and DNA chimeras which include gene sequences and encoding for ferry proteins such as membrane translocating sequences ("MTS") and herpes simplex virus-1 ("VP22")), and viral, liposomes and cationic and anionic polymers and neutral polymers that are selected from a number of types depending on the desired application. Non-limiting examples of virus vectors or vectors derived from viral sources include adenoviral vectors, herpes simplex vectors, papilloma vectors, adeno-associated vectors, retroviral vectors, and the like. Non-limiting examples of biologically active solutes include anti-thrombogenic agents such as heparin, heparin derivatives, urokinase, and PPACK (dextrophenylalanine proline arginine chloromethylketone); antioxidants such as probucol and retinoic acid; angiogenic and anti-angiogenic agents and factors; anti-proliferative agents such as enoxaprin, angiopeptin, rapamycin, angiopeptin, monoclonal antibodies capable of blocking smooth muscle cell proliferation, hirudin, and acetylsalicylic acid; anti-inflammatory agents such as dexamethasone, prednisolone, corticosterone, budesonide, estrogen, sulfasalazine, acetyl salicylic acid, and mesalamine; calcium entry blockers such as verapamil, diltiazem and nifedipine; antineoplastic/antiproliferative/anti-mitotic agents such as paclitaxel, 5-fluorouracil, methotrexate, doxorubicin, daunorubicin, cyclosporine, cisplatin, vinblastine, vincristine, epothilones, endostatin, angiostatin and thymidine kinase inhibitors; antimicrobials such as triclosan, cephalosporins, aminoglycosides, and nitorfurantoin; anesthetic agents such as lidocaine, bupivacaine, and ropivacaine; nitric oxide (NO) donors such as lisidomine, molsidomine, L-arginine, NO-protein adducts, NO-carbohydrate adducts, polymeric or oligomeric NO adducts; anticoagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, Warafin sodium, Dicumarol, aspirin, prostaglandin inhibitors, platelet inhibitors and tick antiplatelet factors; vascular cell growth promotors such as growth factors, growth factor receptor antagonists, transcriptional activators, and translational promotors; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogeneus vascoactive mechanisms; survival genes which protect against cell death, such as anti-apoptotic Bcl-2 family factors and Akt kinase; and combinations thereof. Cells can be of human origin (autologous or allogenic) or from an animal source (xenogeneic), genetically engineered if desired to deliver proteins of interest at the insertion site. Any modifications are routinely made by one skilled in the art.

Polynucleotide sequences useful in practice of the invention include DNA or RNA sequences having a therapeutic effect after being taken up by a cell. Examples of therapeutic polynucleotides include anti-sense DNA and RNA; DNA coding for an anti-sense RNA; or DNA coding for tRNA or rRNA to replace defective or deficient endogenous molecules. The polynucleotides can also code for therapeutic proteins or polypeptides. A polypeptide is understood to be any translation product of a polynucleotide regardless of size, and whether glycosylated or not. Therapeutic proteins and polypeptides include as a primary example, those proteins or polypeptides that can compensate for defective or deficient species in an animal, or those that act through toxic effects to limit or remove harmful cells from the body. In addition, the polypeptides or proteins that can be injected, or whose DNA can be incorporated, include without limitation, angiogenic factors and other molecules competent to induce angiogenesis, including acidic and basic fibroblast growth factors, vascular endothelial growth factor, hif-1, epidermal growth factor, transforming growth factor $\alpha$ and $\beta$, platelet-derived endothelial growth factor, platelet-derived growth factor, tumor necrosis factor $\alpha$, hepatocyte growth factor and insulin like growth factor; growth factors; cell cycle inhibitors including CDK inhibitors; anti-restenosis agents, including p15, p16, p18, p19, p21, p27, p53, p57, Rb, nFkB and E2F decoys, thymidine kinase ("TK") and combinations thereof and other agents useful for interfering with cell proliferation, including agents for treating malignancies; and combinations thereof. Still other useful factors, which can be provided as polypeptides or as DNA encoding these polypeptides, include monocyte chemoattractant protein ("MCP-1"), and the family of bone morphogenic proteins ("BMP's"). The known proteins include BMP-2, BMP-3, BMP-4, BMP-5, BMP-6 (Vgr-1), BMP-7 (OP-1), BMP-8, BMP-9, BMP-10, BMP-11, BMP-12, BMP-13, BMP-14, BMP-15, and BMP-16. Currently preferred BMP's are any of BMP-2, BMP-3, BMP-4, BMP-5, BMP-6 and BMP-7. These dimeric proteins can be provided as homodimers, heterodimers, or combinations thereof, alone or together with other molecules. Alternatively or, in addition, molecules capable of inducing an upstream or downstream effect of a BMP can be provided. Such molecules include any of the "hedgehog" proteins, or the DNA's encoding them.

Coatings used with the present invention may comprise a polymeric material/drug agent matrix formed, for example, by admixing a drug agent with a liquid polymer, in the absence of a solvent, to form a liquid polymer/drug agent mixture. Curing of the mixture typically occurs in-situ. To facilitate curing, a cross-linking or curing agent may be added to the mixture prior to application thereof. Addition of the cross-linking or curing agent to the polymer/drug agent liquid mixture must not occur too far in advance of the application of the mixture in order to avoid over-curing of the mixture prior to application thereof. Curing may also occur in-situ by exposing the polymer/drug agent mixture, after application to the luminal surface, to radiation such as ultraviolet radiation or laser light, heat, or by contact with metabolic fluids such as water at the site where the mixture has been applied to the luminal surface. In coating systems employed in conjunction with the present invention, the polymeric material may be either bioabsorbable or biostable. Any of the polymers described herein that may be formulated as a liquid may be used to form the polymer/drug agent mixture.

The polymer is preferably capable of absorbing a substantial amount of drug solution. When applied as a coating on a medical device in accordance with the present invention, the dry polymer is typically on the order of from about 1 to about 50 microns thick. In the case of a balloon catheter, the thickness is preferably about 1 to 10 microns thick, and more preferably about 2 to 5 microns. Very thin polymer coatings, e.g., of about 0.2–0.3 microns and much thicker coatings, e.g., more than 10 microns, are also possible. It is also within the scope of the present invention to apply multiple layers of polymer coating onto a medical device. Such multiple layers are of the same or different polymer materials.

The polymer may be hydrophilic or hydrophobic, and may be selected, without limitation, from polymers including, for example, polycarboxylic acids, cellulosic polymers, including cellulose acetate and cellulose nitrate, gelatin, polyvinylpyrrolidone, cross-linked polyvinylpyrrolidone, polyanhydrides including maleic anhydride polymers, polyamides, polyvinyl alcohols, copolymers of vinyl monomers such as EVA, polyvinyl ethers, polyvinyl aromatics such as polystyrene and copolymers thereof with other vinyl monomers such as isobutylene, isoprene and butadiene, for example, styrene-isobutylene-styrene (SIBS) copolymers, styrene-isoprene-styrene (SIS) copolymers, styrene-butadiene-styrene (SBS) copolymers, polyethylene oxides, glycosaminoglycans, polysaccharides, polyesters including polyethylene terephthalate, polyacrylamides, polyethers, polyether sulfone, polycarbonate, polyalkylenes including polypropylene, polyethylene and high molecular weight polyethylene, halogenated polyalkylenes including polytetrafluoroethylene, natural and synthetic rubbers including polyisoprene, polybutadiene, polyisobutylene and copolymers thereof with other vinyl monomers such as styrene, polyurethanes, polyorthoesters, proteins, polypeptides, silicones, siloxane polymers, polylactic acid, polyglycolic acid, polycaprolactone, polyhydroxybutyrate valerate and blends and copolymers thereof as well as other biodegradable, bioabsorbable and biostable polymers and copolymers. Coatings from polymer dispersions such as polyurethane dispersions (BAYHDROL®, etc.) and acrylic latex dispersions are also within the scope of the present invention. The polymer may be a protein polymer, fibrin, collage and derivatives thereof, polysaccharides such as celluloses, starches, dextrans, alginates and derivatives of these polysaccharides, an extracellular matrix component, hyaluronic acid, or another biologic agent or a suitable mixture of any of these, for example. In one embodiment, the preferred polymer is polyacrylic acid, available as HYDROPLUS® (Boston Scientific Corporation, Natick, Mass.), and described in U.S. Pat. No. 5,091,205, the disclosure of which is hereby incorporated herein by reference. U.S. Pat. No. 5,091,205 describes medical devices coated with one or more polyisocyanates such that the devices become instantly lubricious when exposed to body fluids. In another preferred embodiment of the invention, the polymer is a copolymer of polylactic acid and polycaprolactone.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. Further, while the various elements of the disclosed invention are described and/or shown in various combinations and configurations, which are exemplary, other combinations and configurations, including more, less or only a single embodiment, are also within the spirit and scope of the present invention.

What is claimed is:

1. A method for applying a coating material onto a portion of a medical device having an accessible surface comprising:

holding the medical device and providing direct access to the accessible surface of the medical device;

positioning a coating nozzle body adjacent the accessible surface of the medical device wherein the coating nozzle body comprises a first fluid passageway having a first inlet and a constricted first nozzle orifice having a first nozzle diameter for discharging the coating;

flowing the coating material through the first fluid passageway towards the constricted first nozzle orifice;

dampening the vibration of the coating nozzle body by choking the first nozzle orifice of the first fluid passageway to maintain a steady back pressure in the first fluid passageway sufficient to stabilize the coating nozzle body against vibration modes from external and internal sources;

atomizing the coating material; and spraying the atomized coating material towards an accessible surface of a portion of the medical device.

2. The method of claim 1 wherein the coating nozzle body further comprises:

a flat surface circumferentially surrounding the first nozzle orifice; and a second fluid passageway having a second inlet; and a second nozzle orifice having a second nozzle diameter;

wherein the second nozzle orifice is positioned concentric with the first nozzle orifice and the second nozzle diameter is larger than the first nozzle diameter.

3. The method of claim 2 wherein the atomizing step comprises:

flowing the coating material from the first nozzle orifice onto the flat surface of the nozzle body to create a film layer of coating material on the flat surface;

flowing an atomizing fluid through the second fluid passageway towards the second nozzle orifice at a first velocity;

ejecting the atomizing fluid from the second orifice at a second velocity greater than the first velocity; and entraining a portion of the film layer of coating material within the atomizing fluid ejected from the second orifice at a second velocity;

wherein the film layer of coating material is atomized into a plurality of coating material particles within the atomizing fluid.

4. The method of claim 3 further comprising:

pumping an atomizing fluid from an atomizing fluid reservoir, wherein the atomizing fluid reservoir is in fluid communication with the second fluid passageway, and the atomizing fluid flows from the atomizing fluid reservoir through the second inlet of the second fluid passageway towards the second nozzle orifice.

5. The method of claim 1 wherein the diameter of the first nozzle orifice is less than 0.35 mm.

6. The method of claim 1 wherein the diameter of the first nozzle orifice is 0.15 mm.

7. The method of claim 1 wherein the coating material is a therapeutic agent.

8. The method of claim 1 wherein the medical device is a stent.

9. The method of claim 1 wherein the coating nozzle body is a spray nozzle body.

* * * * *

UNITED STATES PATENT AND TRADEMARK OFFICE

CERTIFICATE OF CORRECTION

PATENT NO. : 6,979,473 B2
APPLICATION NO. : 10/799589
DATED : December 27, 2005
INVENTOR(S) : O'Conner et al.

It is certified that error appears in the above-identified patent and that said Letters Patent is hereby corrected as shown below:

Column 6,
Line 43, change "threrapeutic" to -- therapeatic --;
Line 51, change "andenoassociated" to -- adenoassociated --;

Column 7,
Line 1, change "viral, liposomes" to -- viral liposomes --;
Line 13, change "enoxaprin" to -- enoxaparin --;
Line 25, change "nitorfurantoin" to -- nitrofurantoin --;
Line 27, change "lisidomine" to -- linsidomine --;
Line 34, change "Warafin" to -- Warfarin --;
Lines 36 and 38, change "promotor" to -- promoter --;
Line 46, change "endogeneus" to -- endogenous --;

Column 9,
Line 25, change "BAYHDROL" to -- BAYHYDROL --.

Signed and Sealed this

Twenty-seventh Day of June, 2006

JON W. DUDAS
*Director of the United States Patent and Trademark Office*